US007972991B2

(12) United States Patent
Nojima et al.

(10) Patent No.: US 7,972,991 B2
(45) Date of Patent: Jul. 5, 2011

(54) HEAT-SENSITIVE RECORDING MATERIAL

(75) Inventors: Masaharu Nojima, Hyogo (JP); Takashi Takemura, Hyogo (JP)

(73) Assignee: Oji Paper Co., Ltd., Tokyo (JP)

( * ) Notice: Subject to any disclaimer, the term of this patent is extended or adjusted under 35 U.S.C. 154(b) by 798 days.

(21) Appl. No.: 12/071,949

(22) Filed: Feb. 28, 2008

(65) Prior Publication Data

US 2009/0099018 A1 Apr. 16, 2009

(30) Foreign Application Priority Data

Oct. 11, 2007 (JP) ..... 2007-265091

(51) Int. Cl.
*B41M 5/333* (2006.01)
*B41M 5/337* (2006.01)

(52) U.S. Cl. ..... 503/209; 427/150; 503/216

(58) Field of Classification Search ..... None
See application file for complete search history.

(56) References Cited

U.S. PATENT DOCUMENTS

| | | | | |
|---|---|---|---|---|
| 5,801,288 | A | 9/1998 | Fuji et al. | |
| 5,955,398 | A | 9/1999 | Fisher et al. | |
| 7,618,922 | B2 * | 11/2009 | Ogino et al. | 503/226 |
| 2005/0096221 | A1 | 5/2005 | Fisher et al. | |

FOREIGN PATENT DOCUMENTS

| | | |
|---|---|---|
| JP | 10-297090 | 11/1998 |
| JP | 10-297092 | 11/1998 |
| JP | 2001-080219 | 3/2001 |
| JP | 2004-276281 | 10/2004 |

* cited by examiner

*Primary Examiner* — Bruce H Hess
(74) *Attorney, Agent, or Firm* — Bacon & Thomas, PLLC

(57) ABSTRACT

Disclosed herein is a heat-sensitive recording material shows good barcode printability and provides printed images having an excellent milk resistance. The heat-sensitive recording material comprises a heat-sensitive recording layer contains 3,3'-diallyl-4,4'-dihydroxydiphenylsulfone and 1,2-di(methylphenoxy)ethane in a specific amount relative to the leuco dye, and contains a crosslinked diphenylsulfone-based compound in an specific ratio based on the total solid in the heat-sensitive recording layer.

7 Claims, No Drawings

HEAT-SENSITIVE RECORDING MATERIAL

TECHNICAL FIELD

The present invention relates to a heat-sensitive recording material exhibiting a good barcode printability and providing printed images having a high density and excellent resistances to not only plasticizer and oil but also milk.

BACKGROUND ART

A heat-sensitive recording material is relatively inexpensive because printed images can be obtained by simply heating it for allowing reaction between a leuco dye and a color developer. Also, recording devices for forming printed images from the heat-sensitive recording material are compact and easy maintenance can be used for the devices. From these advantages, a heat-sensitive recording material has been used as recording media for facsimile and printers of scientific measuring instruments, and various calculators. In recent years, a heat-sensitive recording material has become used as recording media such as POS labels, various tickets, lottery, and output media for automatic ticket vending-machines (ATM), CAD, handy-terminal and so on. Under the circumstances, the printed images are severely required to exhibit clearness when developed, and secure the clearness thereof for a long term.

Japanese Unexamined Patent Application Publication No. Hei 8-333329 (D1) proposes a crosslinked diphenylsulfone-based compound having a specific chemical formula, as a color stabilizer serving for preservation stability of a color image, particularly superior plasticizer resistance. Japanese Unexamined Patent Application Publication No. Hei 10-297090 (D2) discloses that use of the aforementioned crosslinked diphenylsulfone-based compound in combination with a hydroxydiphenylsulfone derivative is advantageous in improving dynamic sensitivity of development and plasticizer resistance.

Japanese Unexamined Patent Application Publication No. Hei 10-297092 (D3) proposes that printed images having improved water resistance, plasticizer resistance, and preservability in a high-temperature condition or a high-temperature high-humidity condition can be obtained by containing the crosslinked diphenylsulfone-based compound shown in D1, as a preservability-improving agent, in a concentration of 1 to 30% by weight of the total solid content. Example 10 in D3 discloses combination of bis(3-allyl-4-hydroxylphenyl)sulfone as a color developer, and 1,2-di(3-methylphenoxy)ethane as a sensitizer.

Japanese Unexamined Patent Application Publication No. 2001-80219 (D4) discloses a heat-sensitive recording material exhibiting good resistances to plasticizer, oil and humidity/heat (image preservability under 30° C., 80% RH) with respect to its printed images. The heat-sensitive recording material is produced by using the crosslinked diphenylsulfone-based compound shown in D1 as a color developer in combination with a graft copolymer of a starch and a polyvinyl acetate as an adhesive agent. D4 also recites that use of bis(3-allyl-4-hydroxyphenyl)sulfone as a color developer is advantageous in improving sensitivity of development, and preservability of printed images with time.

Japanese Unexamined Patent Application Publication No. 2004-276281 (D5) discloses that a heat-sensitive recording material with superior heat resistance and light resistance of unprinted portion, and superior plasticizer resistance and oil resistance of printed images is obtained by using a crosslinked diphenylsulfone-based compound and N-p-toluenesulfonyl-N'-3-(p-toluenesulfonyloxy)phenylurea as a color developer in combination with (3-(N-ethyl-p-toluidino)-6-methyl-7-anilinofuruorane) as a leuco dye. Comparative Example 4 in D5 discloses that oil resistance and plasticizer resistance are also exhibited by using bis(3-allyl-4-hydroxyphenyl) sulfone, in place of N-p-toluenesulfonyl-N'-3-(p-toluenesulfonyloxy)phenylurea.

In the heat-sensitive recording material, which is used as receipt in a POS (point of sales) system, various tickets, cash vouchers such as lottery tickets, or like sheets, improved plasticizer resistance, oil resistance, humidity/heat resistance of printed images are required. Furthermore, there is a demand for preserving printed images against daily household goods such as foods or drugs e.g. hand cream, milk, or vinegar. Among the foods or drugs, milk acts differently on printed images, unlike an oil or water, because milk is a mixture containing a milk fat, a protein, water, and the like. Owing to the complex composition of milk, even if printed images of a heat-sensitive recording material have sufficient oil resistance and/or water resistance, there are some cases that the printed images spilt with milk is likely to fade or discolor.

It is possible to secure preservability of printed images by increasing an initial printed density. However, in the case that printed images are barcode, for example a cash voucher or a like sheet, if an initial printed density is increased simply by increasing sensitivity of development, clearness of an edge of a thin line of the barcode may be impaired. This may cause another problem that desirable barcode printability may not be secured.

As described above, in recent years, there is a demand for securing milk resistance of printed images, without impairing barcode printability. Unfortunately, the conventional technology aiming at improving oil resistance and plasticizer resistance is not sufficient to satisfy the demand.

SUMMARY OF THE INVENTION

In view of the above problems residing in the conventional art, an object of the invention is to provide a heat-sensitive recording material which enables to suppress decoloration or fade of printed images to be caused by contact with milk, without impairing barcode printability.

Inventors studied many combinations of leuco dyes, color developers, sensitizers and various crosslinked diphenylsulfone-based compounds and found a combination capable of achieving the above object, and have completed the invention.

One aspect of the invention is a heat-sensitive recording material comprising a support and a heat-sensitive recording layer placed over the support. The heat-sensitive recording layer comprises a leuco dye; a color developer including 3,3'-diallyl-4,4'-dihydroxydiphenylsulfone; a sensitizer including 1,2-di(methylphenoxy)ethane; a crosslinked diphenylsulfone-based compound represented by the general formula (1) wherein n represents an integer of from 1 to 7; and a binder.

Formula (1)

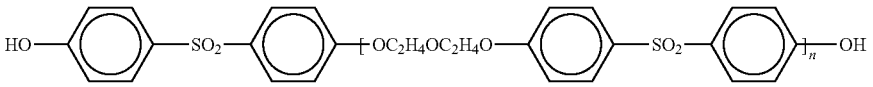

(1)

An amount of the 3,3'-diallyl-4,4'-dihydroxydiphenylsulfone is in the range of 100 to 200 parts by mass and an amount of the 1,2-di(methylphenoxy)ethane is in the range of 20 to 90 parts by mass, wherein the parts by mass is based on 100 part by mass of the leuco dye. And an amount of the crosslinked diphenylsulfone-based compound falls in the range of 5 to 10% by mass based on the total mass of solid contained in the heat-sensitive recording layer.

Another aspect of the invention is a method of producing a heat-sensitive recording material obtainable a printed image having milk resistance. The method comprises a step of preparing a composition which contains 3,3'-diallyl-4,4'-dihydroxydiphenylsulfone in an amount of 100 to 200 parts by mass and 1,2-di(methylphenoxy)ethane in an amount of 20 to 90 parts by mass both based on 100 parts by mass of a leuco dye, and contains a crosslinked diphenylsulfone-based compound represented by the general formula (1) in an concentration of 5 to 10% by mass based on the total mass of solid contained in the heat-sensitive recording layer wherein n represents an integer of from 1 to 7; and a step of forming a heat-sensitive recording layer of the composition.

The inventive heat-sensitive recording material can provide printed images still having a reflectance of 30% or less at a wavelength of 660 nm, after a thermal-recorded heat-sensitive recording material is immersed in milk for 12 hours, taken out of the milk, followed by removal of an excess of milk by absorption, and let stand for 10 minutes or more at room temperature to dry. Accordingly, the heat-sensitive recording material of the invention is advantageous to be used where milk resistance of printed images is required. Furthermore, with use of the inventive heat-sensitive recording material, printing can be performed with satisfactory barcode printability, while securing preservability of printed images under exposure of foods such as milk, not to mention plasticizer resistance and oil resistance.

DETAILED DESCRIPTION OF THE INVENTION

A heat-sensitive recording material generally comprises a support and a heat-sensitive recording layer placed over the support.

As the support, any support known in this field may be used for a heat-sensitive recording material of the invention. Non-limiting examples of the support include a neutralized or acidic woodfree paper, synthetic paper, transparent or semi-transparent plastic film, white plastic film, or the like. The thickness of the support is not particularly limited, and is usually, within the range of about 20 to about 200 μm.

Heat-sensitive Recording Layer

According to the invention, a heat-sensitive recording layer comprises a leuco dye, a color developer including 3,3'-diallyl-4,4'-dihydroxydiphenylsulfone, a sensitizer including 1,2-di(methylphenoxy)ethane, a crosslinked diphenylsulfone-based compound represented by the general formula (1), and a binder.

Formula (I)

In the formula (1), n represents an integer of from 1 to 7. Hereinafter, each component will be described.

As the leuco dye, there may be used a known preferable leuco dye, for example, triphenylmethane dye, fluoran-based dye, phenothiazine-based dye, auramine-based dye, spiropyran-based dye, indolylphtalide-based dye. Specific examples of the leuco dye include 3-(4-diethylamino-2-ethoxyphenyl)-3-(1-ethyl-2-methylindole-3-yl)-4-azaphthalide, crystalviolet lactone, 3-(N-ethyl-N-isopentylamino)-6-methyl-7-anilinofluoran, 3-diethylamino-6-methyl-7-anilinofluoran, 3-diethylamino-6-methyl-7-(o,p-dimethylanilino)fluoran, 3-(N-ethyl-N-p-toluidino)-6-methyl-7-anilinofluoran, 3-(N-ethyl-p-toluidino)-6-methyl-7-(p-toluidino)fluoran, 3-pyrrolidino-6-methyl-7-anilinofluoran, 3-di(n-butyl)amino-7-(o-chloroanilino)fluoran, 3-di(n-butyl)amino-6-methyl-7-anilinofluoran, 3-di(n-pentyl)amino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran, 3-(N-ethyl-N-hexylamino)-6-methyl-7-(p-chloroanilino)fluoran, and 3,6-bis(dimethylamino)fluorene-9-spiro-3'-(6'-dimethylamino)phthalide.

These leuco dyes may be used alone or in combination of two or more thereof.

Among these leuco dyes, 3-di(n-butyl)amino-6-methyl-7-anilinofluoran is preferably used due to its excellent sensitivity for development.

The amount of leuco dye contained in the heat-sensitive recording layer is preferably within the range of about 5 to about 25%, more preferably of 7 to 20% by mass based on the total solid content of the heat-sensitive recording layer. A preferable average diameter of the leuco dye is from 0.1 to 3 μm, more preferably is 0.3 to 1.5 μm. The term "average diameter" as used herein means a median of particle diameters of powder measured in the form of dispersion with a laser diffraction particle size distribution analyzer.

The heat-sensitive recording layer also contains 3,3'-diallyl-4,4'-dihydroxydiphenylsulfone, which can act as a color developer by coming into contact with a leuco dye. According to the invention, an amount of 3,3'-diallyl-4,4'-dihydroxydiphenylsulfone is in the range of 100 to 200 parts, preferably 100 to 190 parts, further more preferably 100 to 180 parts by mass, based on 100 parts by mass of the leuco dye contained in the heat-sensitive recording layer. 3,3'-diallyl-4,4'-dihydroxydiphenylsulfone reacts with the leuco dye to give

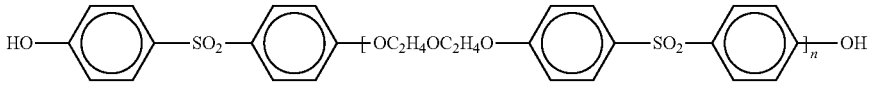

(1)

printed images having superior absorption at 660 nm. In particular, when combined it with 1,2-di(methylphenoxy) ethane through adjustment of their combination ratio, range of allowable energy can broaden so that printed barcode having clear edge is obtained. Furthermore, 3,3'-diallyl-4,4'-dihydroxydiphenylsulfone can contribute to improve a milk resistance of printed images. By adjusting the combination ratio in the combination with the crosslinked diphenylsulfone-based compound having a specific structure described above, discoloration of the printed images to be caused by milk can be suppressed, but the mechanism of it is not clarified.

With respect to 3,3'-diallyl-4,4'-dihydroxydiphenylsulfone, it is preferable to use particles having an average diameter of about 0.1 to 3 μm, more preferably about 0.3 to 1.5 μm.

The heat-sensitive recording layer also comprises 1,2-di(3-methylphenoxy)ethane as a sensitizer.

20 to 90 parts by mass, more preferably 25 to 85 parts by mass, and furthermore preferably 30 to 80 parts by mass of 1,2-di(3-methylphenoxy)ethane is contained relative to 100 parts by mass of the leuco dye in the heat-sensitive recording layer. If the content of 1,2-di(3-methylphenoxy)ethane is over the upper limit, sensitivity of development may be unduly increased. As a result, even if the content of the color developer lies within the appropriate range, at the time of printing a barcode, the line width may be unduly increased, or an edge of a line may be blurred, thereby making it difficult to print a barcode of sharp and thin lines. On the other hand, if the content of 1,2-di(3-methylphenoxy)ethane is under the lower limit, sensitivity of development may be unduly reduced. As a result, at the time of printing a barcode, a thin line of the barcode may have an unduly small density, which may make it difficult to secure preservability of printed images, not to mention lowering the initial barcode readability.

The heat-sensitive recording layer further comprises a crosslinked diphenylsulfone-based compound expressed by the formula (1) shown above wherein n represents an integer of from 1 to 7. Hereinafter, this crosslinked diphenylsulfone-based compound is simply called as "the crosslinked diphenylsulfone-based compound (1)".

The crosslinked diphenylsulfone-based compound (1) may be a single compound where the value of n in the formula (1) is any single number selected from 1 to 7, or a mixture where the value of n in the formula (1) is two or more numbers selected from 1 to 7. The crosslinked diphenylsulfone-based compound (1) to be contained may, as a whole, have a degradation temperature preferably of 110 to 180° C., and more preferably of 110 to 170° C. Usually, if the compound represented by formula (1) wherein n=1 and/or 2 is contained in the concentration of about 50 to 80%, the degradation temperature of the crosslinked diphenylsulfone-based compound (1) can fall in the aforementioned range. The degradation temperature is a temperature measured by a DSC (differential scanning calorimeter).

The crosslinked diphenylsulfone-based compound (1) may act as a color developer as well as a stabilizer for printed images. Particularly, a combination of the crosslinked diphenylsulfone-based compound (1) and 3,3'-diallyl-4,4'-dihydroxydiphenylsulfone can provide printed images with excellent milk resistance by setting an appropriate content ratio of them.

An amount of the crosslinked diphenylsulfone-based compound (1) is in the range of 5 to 10%, preferably 5 to 9.5%, more preferably 5 to 9% by mass based on the total mass of the solid in the heat-sensitive recording layer. And the content ratio of 3,3'-diallyl-4,4'-dihydroxydiphenylsulfone:the crosslinked diphenylsulfone-based compound (1) is preferably from 1:0.4 to 1:0.8, more preferably 1:0.4 to 1:0.7. If the content ratio of the crosslinked diphenylsulfone-based compound (1) is too high, the density of the printed images tends to lower. On the other hand, if the amount of the crosslinked diphenylsulfone-based compound (1) is too small, it tends to be difficult to obtain printed images with a sufficient milk resistance, even if both of 3,3'-diallyl-4,4'-dihydroxydiphenylsulfone and 1,2-di(methylphenoxy)ethane are contained in amounts satisfying the range mentioned above.

As the crosslinked diphenylsulfone-based compound (1), it is preferable to use particles having an average diameter of about 0.1 to 3 μm, more preferable of about 0.3 to 1.5 μm.

The heat-sensitive recording layer may contain other color developers besides 3,3'-diallyl-4,4'-dihydroxydiphenylsulfone and the crosslinked diphenylsulfone-based compound (1), insofar as the desired effects of the invention are not impaired. Non-limiting examples of the other color developers include phenolic compounds such as 4-hydroxy-4'-isopropoxy-diphenylsulfone, 4-hydroxy-4'-allyloxy-diphenylsulfone, 4,4'-isopropylidenediphenol, 4,4'-cyclohexylidenediphenol, 2,2-bis(4-hydroxyphenyl)-4-methylpentane, 2,4'-dihydroxy-diphenylsulfone, 4,4'-dihydroxy-diphenylsulfone, 4-hydroxy-4'-methyldiphenylsulfone, 1,4-bis[α-methyl-α-(4'-hydroxyphenyl)ethyl]benzene or the like; compound having sulfonyl- and ureido-groups in its molecular such as N-p-tolylsulfonyl-N'-phenylurea, 4,4'-bis[(4-methyl-3-phenoxycarbonylaminophenyl)ureido]diphenylmethane, N-p-tolylsulfonyl-N'-p-butoxyphenylurea or the like; zinc salts of aromatic carboxylic acids such as zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy) cumyl]salicylate or the like. A total amount of color developers including 3,3'-diallyl-4,4'-dihydroxydiphenylsulfone and the crosslinked diphenylsulfone-based compound (1) of the heat-sensitive recording layer preferably falls in the range of about 170 to about 400 parts by mass based on 100 parts by mass of the leuco dye.

As far as the desired effects of the invention are not impaired, other sensitizers may be used together with 1,2-di (methylphenoxy)ethane. Examples of other sensitizers include stearic acid amide, methylenebisstearamide, ethylenebisstearamide, 4-benzylbiphenyl, p-tolyl biphenyl ether, di(p-methoxyphenoxyethyl)ether, 1,2-di(4-methylphenoxy) ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, 2-naphthyl benzyl ether, 1-(2-naphthyloxy)-2-phenoxyethane, 1,3-di(naphtyloxy) propane, di(p-chlorobenzyl) oxalate, di(p-methylbenzyl) oxalate, dibutyl terephthalate, dibenzyl terephtalate, 2-(2'-hydroxy-5'-methylphenyl)benzotriazole and so on. A preferable amount of sensitizers including 1,2-di(methylphenoxy) ethane falls in the range of about 20 to 120 parts by mass based on 100 parts by mass of the leuco dye.

The heat-sensitive recording layer further comprises a binder.

Examples of the binder include water-soluble resins such as polyvinyl alcohol having a variety of molecular weights, modified polyvinyl alcohol, starch and its derivatives; cellulose derivatives such as carboxymethyl cellulose, methyl cellulose and ethyl cellulose or the like; water-soluble polymeric materials such as sodium polyacrylate, polyvinyl pyrrolidone, acrylamide-acrylate copolymer, acrylamide-acrylate-methacrylic acid terpolymer, styrene-maleic anhydride copolymer, polyacrylamide, sodium alginate, gelatin, and casein or the like; and latex of hydrophobic polymer such as polyvinyl acetate, polyurethane, styrene-butadiene copolymer, polyacrylic acid, polyacrylic acid ester, vinyl chloride-vinyl acetate copolymer, polybutylmethacrylate, ethylene-vinyl acetate copolymer, and styrene-butadiene-acrylate terpolymer, or the like. Such a binder may be used alone or in combination of two or more thereof. An amount of the binder is not particularly limited, but is preferably from about 5 to about 30%, more preferably from about 6 to about 25% by mass based on the total mass of the solid of the heat-sensitive recording layer.

Moreover, the heat-sensitive recording layer may contain known pigments used in an ordinary heat-sensitive recording material. Examples of such pigments include kaolin, light calcium carbonate, ground calcium carbonate, calcined kaolin, amorphous silica, titanium oxide, magnesium carbonate, aluminium hydroxide, urea-formalin resin filler and plastic pigments or the like. Moreover, the heat-sensitive recording layer may contain various known auxiliaries such as lubricant, antifoaming agent, wetting agent, antiseptics, fluorescent brightening agent, dispersing agent, thickener, coloring agent, antistatic agent, and crosslinking agent. Examples of the lubricant include zinc stearate, calcium stearate, polyethylene wax, paraffin wax, olefine resin emulsion and so on.

The heat-sensitive recording layer is formed, for example, as follows. A said leuco dye, a color developer including 3,3'-diallyl-4,4'-dihydroxydiphenylsulfone, a sensitizer including 1,2-di(methylphenoxy)ethane, the crosslinked diphenylsulfone-based compound (1) and a binder, and if desired, a pigment and various auxiliaries are added to water, and the resultant solution or dispersion is stirred to prepare a coating composition. The heat-sensitive recording layer is formed by applying and drying the coating composition.

A coating composition for heat-sensitive recording layer may be prepared by adding aforementioned components to water in a predetermined amount and dispersing them in water. Alternatively, a coating composition may be prepared by preparing each dispersion of leuco dye, 3,3'-diallyl-4,4'-dihydroxydiphenylsulfone, 1,2-di(methylphenoxy)ethane, and the crosslinked diphenylsulfone-based compound (1) respectively, and then mixing all the dispersions at a predetermined ratio. In the latter preparation, a binder may be added to one or all dispersions. The particle diameters of the solids may be adjusted by pulverizing in form of dispersion by means of an ultrasound mill, high-speed rotation mill, roller mill, ball mill, media-agitating mill, jet mill, sand grinder, medialess micropulverizing apparatus or the like.

A coating method of the heat-sensitive recording layer coating composition is not particularly limited. Any conventional coating method, for example, air knife coating, Vari-Bar blade coating, pure blade coating, gravure coating, rod blade coating, shorted well coating, curtain coating, bar coating, die coating, or the like, may be employed in the invention.

The heat-sensitive recording layer may be placed on the support directly. In order to enhance a sensitivity of development and recording runnability, an undercoat layer may be provided between the support and the heat-sensitive recording layer.

Undercoat Layer

The undercoat layer is formed on the support by drying after applying a coating composition which contains a binder and at least one selected from the group consisting of hollow particles, thermal-expansion particles, oil-absorbing pigments having an oil absorption of 70 ml/100 g or more, particularly from about 80 to about 150 ml/100 g, as main components. The oil absorption is a measurement value according to JIS K 5101-2004.

As the oil-absorbing pigment, insofar as the oil absorption is satisfied, any kinds of oil-absorbing pigments may be used. Specific examples of such oil-absorbing pigments include calcined clay, calcined kaolin, light calcium carbonate, or similar inorganic pigments. Moreover, oil-absorbing pigments having an average particle diameter of about 0.01 to 5 μm, particularly about 0.02 to 3 μm, is preferably used. The average diameter is a 50 percent value determined by a laser diffraction particle size distribution analyzer (trade name: SALD2200, manufactured by SHIMADZU CORPORATION). The use amount of the oil-absorbing pigment may be selected from the wide range, preferable range of 2 to 95%, more preferable range of 5 to 90% by mass based on the total mass of the solid in the undercoat layer.

Examples of the organic hollow particles are conventionally well-known particles having a hollow rate of about 50 to 99%, wherein an acrylic resin, a styrene resin, a vinylidene chloride resin, or a like resin is used as a membrane. The hollow rate is a value obtained by performing a computation: $(d/D)\times 100$, where d is an inner diameter of the organic hollow particle, and D is an outer diameter of the organic hollow particle. The average particle diameter of the organic hollow particles (a 50 percent value determined by a laser diffraction particle size distribution analyzer (product name: SALD-2200 by SHIMADZU CORPORATION) is preferably about 0.5 to 10 μm, and particularly preferably about 1 to 3 μm. The amount of the organic hollow particles to be used is selected from a wide range. Generally, the amount of the organic hollow particles used in the invention is preferably about 2 to 90% by mass, more preferably about 5 to 70% by mass based on the total solid content of the undercoat layer.

In the case where the oil-absorptive inorganic pigment is used in combination with the organic hollow particles, it is preferable to use the oil-absorptive inorganic pigment and the organic hollow particles in the aforementioned content ranges in such a manner that the total content of the oil-absorptive inorganic pigment and the organic hollow particles is preferably from about 5 to 90% by mass, and particularly preferably from about 10 to 80% by mass based on the total solid content of the undercoat layer.

Any of known thermal-expansion particles may be used in the invention. Specific examples of the thermal-expansion particles include thermal-expansion fine particles obtained by microcapsulation of low boiling point hydrocarbons with copolymers, such as vinylidene chloride, acrylonitrile, by in situ polymerization. Examples of the low boiling hydrocarbons include ethane, propane, etc. The use amount of the thermal-expansion particle may be selected from a wide range, preferably about 1 to 80%, about 10 to 70% by mass based on the total mass of solids in the undercoat layer.

A binder usable for the heat-sensitive recording layer may be used at will for the undercoat layer. Preferable examples of the binder include graft copolymer of starch and polyvinyl acetate, various polyvinyl alcohols, and styrene-butadiene copolymer latex. Examples of the polyvinyl alcohols include completely saponified polyvinyl alcohol, partially saponified polyvinyl alcohol, carboxy-modified polyvinyl alcohol, acetoacetyl-modified polyvinyl alcohol, diaceton-modified polyvinyl alcohol, silicon-modified polyvinyl alcohol, and so on. The use amount of the binder may be determined in the wide range, preferably in the range of 5 to 30%, particularly in the range of 10 to 25% by mass based on the total solid of the undercoat layer.

The undercoat layer may contain various known auxiliaries such as lubricant, antifoaming agent, wetting agent, antiseptics, fluorescent brightening agent, dispersing agent, thickener, coloring agent, antistatic agent, and crosslinking agent, and so on.

The undercoat layer coating composition is applied in a preferable amount of about 3 to about 20 g/m$^2$, more preferable amount of about 5 to about 18 g/m$^2$ on a dry weight basis. Repeated applications of the undercoat layer coating composition twice or more are preferable in view of improvement of sensitivity of development and durability of printed images.

Protective Layer

A heat-sensitive recording material of the invention may further comprise a protective layer, if desired. The protective layer comprises a binder capable of forming film as a main component. A protective layer coating composition is prepared by mixing and stirring a binder, a pigment, and if necessary, auxiliaries, in water serving as a media. A binder, a pigment, auxiliaries usable in the heat-sensitive recording layer may be employed for the protective layer.

Other Layers

If desired, a glossy layer may be provided on a protective layer. The glossy layer is formed by applying a coating composition containing an electron beam- or UV curable compound as a main component and curing the coating composition by irradiating electron beam or a UV ray. Furthermore, if desired, an antistatic layer may be provided on the back side of the support.

Each of undercoat layer, protective layer, and glossy layer may be formed by applying a coating composition for the respective layer with use of coating method usable for the heat-sensitive recording layer, e.g. air knife coating, pure blade coating, gravure coating, rod blade coating, curtain coating, bar coating, die coating, or the like, and then drying the coating.

After forming the respective layers, or after forming all the layers constituting the heat-sensitive recording material, various well-known processing to be used in the field of manufacturing heat-sensitive recording materials such as super calendaring may be performed according to needs.

A heat-sensitive recording material of the invention has superior barcode printability, and has a wide range of sensitivity of development capable of printing a barcode having a sharp edge of the thin lines of the barcode printed, thus providing superior usability. Furthermore, the heat-sensitive recording material of the invention enables to provide printed images having superior resistance to not only oil and plasticizer but also foods having a complex composition such as milk, not to mention water and oil. Specifically, printed images formed from the heat-sensitive recording material still have a reflectance of 30% or less, and more preferably less than 25% at a wavelength of 660 nm, after a thermal-recorded heat-sensitive recording material is immersed in milk for 12 hours, taken out of the milk, followed by removal of an excess of milk by absorption, and let stand for 10 minutes at room temperature to dry.

Such a heat-sensitive recording material can be produced by a method of the invention. The producing method comprises a step of preparing a composition which contains 3,3'-diallyl-4,4'-dihydroxydiphenylsulfone in an amount of 100 to 200 parts by mass and 1,2-di(methylphenoxy)ethane in an amount of 20 to 90 parts by mass both based on 100 parts by mass of the leuco dye, and contains the aforementioned crosslinked diphenylsulfone-based compound (1) in an concentration of 5 to 10% by mass based on the total mass of solid in the heat-sensitive recording layer; and a step of forming a heat-sensitive recording layer of the composition.

Usually, the composition for heat-sensitive recording layer is applied to a support or an undercoat layer placed on the support, and dried. As a result, a heat-sensitive recording material comprising the heat-sensitive recording layer made of the composition is obtained. The heat-sensitive recording material can provide a printed image having milk resistance.

EXAMPLES

The present invention will be illustrated in further detail with reference to Examples below. It should be understood that the scope of the invention is not limited by the Examples. Herein, "parts" and "%" represent "parts by mass" and "% by mass", respectively, unless otherwise specified.

[Evaluation Method]

(1) Plasticizer Resistance of Printed Images

A wrap film (trade name: Hiwrap KMA-W, Mitsui Chemical) was wound three times around a polycarbonate pipe (40 mm in diameter). After recording with a thermal printer Atlantek 300 (product of Printrex, high energy, standard pattern), three sheets of a heat-sensitive recording material as samples were each superposed on the wrap film. Then, another wrap film was wound three times over the samples. After letting the polycarbonate pipe wrapped with the wrap films stand for 24 hours at 23° C., the wrap films were peeled off. A reflectance at a wavelength of 660 nm at Step 8 (printing energy of 0.464 mJ/dot) was measured at five sites with respect to each sample, and the average of the measurements was defined as a measurement result. A reflectance of 30% or less at the wavelength of 660 nm was defined as the passing standard.

(2) Oil Resistance of Printed Images

With respect to three sheets of a heat-sensitive recording material as samples, a printed image was formed on each of these samples with the thermal printer Atlantek 300 (product of Printrex, high energy, standard pattern), and then was coated with a cooking oil. The samples were let stand for 24 hours at 23° C. After the lapse of 24 hours, the cooking oil was wiped off, and a reflectance at a wavelength of 660 nm at Step 8 was measured at five sites with respect to each sample. The average of the measurements was defined as a measurement result. A reflectance of 30% or less at the wavelength of 660 nm after the cooking oil removal was defined as the passing standard.

(3) Barcode Printability

Serial bars were printed on a heat-sensitive recording material with different printing energies by a barcode printer Intermec 3400e by changing the printing energy in 21 stages from a low energy to a high energy. The barcodes printed with the different printing energies were scanned by a barcode scanner having a scanning wavelength of 660 nm. The bar width growth in the printed barcodes was observed, and the printing energy range capable of obtaining bars having the bar width growth of ±0.05% was estimated. A wider printing energy range means superior barcode printability. Barcode printability was evaluated by the following four evaluation stages, based on the printing energy range and clearness or sharpness at an edge of a line.

Rank A: very good performance, because the range where the bar width growth is ±0.05% covers 9 or more stages of printing energy.

Rank B: practically allowable performance, because the range where the bar width growth is ±0.05% covers 5 to 8 stages of printing energy.

Rank C: practically unallowable performance, because the range where the bar width growth is ±0.05% covers merely 4 or less stages of printing energy, and the density of the printed image is low.

Rank D: practically unusable as a barcode, because the range where the bar width growth is ±0.05% covers merely 4 or less stages of printing energy, the line width is too wide, and an edge of the line is bloomed.

(4) Milk Resistance of Printed Images

After forming printed images on three sheets of a heat-sensitive recording material as samples with the thermal printer Atlantek 300 (product of Printrex, high energy, standard pattern), the samples were immersed in refrigerated milk, and let stand for 12 hours at room temperature. After the lapse of 12 hours, the samples were taken out of the milk, and an excess of milk was removed by absorption by sandwiching the samples with a paper towel while pressing gently. Then, the samples were let stand at least for 10 minutes or more at room temperature to dry. After the drying, a reflectance at a wavelength of 660 nm at Step 8 was measured at five sites with respect to each sample. The average of the measurements was defined as a measurement result. A reflectance of 30% or less at the wavelength of 660 nm after the contact with milk was defined as the passing standard.

[Manufacture of Heat-sensitive Recording Material No. 1]

(1) Preparation of Undercoat Layer Coating Composition

An undercoat layer coating composition was prepared by stirring a composition composed of 100 parts of calcined kaolin (trade name: Ansilex 93, manufactured by Engelhard Corporation), 12.5 parts of stylene-butadiene latex having solid content of 48%, 30 parts of 10% aqueous solution of oxidized starch, 45 parts of 10% aqueous solution of polyvinyl alcohol, and 96.5 parts of water.

(2) Preparation of Solution A

A composition composed of 100 parts of 3-di(n-butyl) amino-6-methyl-7-anilinofluoran, 70 parts of 10% aqueous solution of sulfone-modified polyvinyl alcohol, and 44 parts of water was pulverized by Ultra Visco Mill (manufactured by Aymex Co. Ltd.) to an average particle diameter of 1.0 μm, giving Solution A.

(3) Preparation of Solution B

A composition composed of 100 parts of 3,3'-diallyl-4,4'-dihydroxydiphenylsulfone (hereinafter, may be also called briefly as "Developer 1"), 100 parts of 10% aqueous solution of sulfone-modified polyvinyl alcohol, and 20 parts of water was pulverized by Ultra Visco Mill (manufactured by Aymex Co. Ltd.) to an average particle diameter of 1.0 μm, giving Solution B.

(4) Preparation of Solution C

A composition composed of 100 parts of 1,2-di(methylphenoxy)ethane, 20 parts of 10% aqueous solution of hydroxypropylmethyl cellulose, 20 parts of 10% aqueous solution of polyvinyl alcohol, and 68 parts of water was pulverized by Ultra Visco Mill (Aymex Co. Ltd.) to an average particle diameter of 1.0 μm, giving Solution C.

(5) Preparation of Solution D

A composition composed of 100 parts of D-90 (code name of Nippon Soda Co., Ltd.) as a compound selected from the crosslinked diphenylsulfone-based compound (1), 100 parts of 10% aqueous solution of sulfone-modified polyvinyl alcohol and 20 parts of water was pulverized by Ultra Visco Mill (Aymex Co. Ltd.) to an average particle diameter of 1.0 μm, giving Solution D. D-90 is a mixture of compounds represented by the formula (1) wherein n=1 to 7, and mainly contains compounds represented by the formula (1) wherein n is 1 and 2. D-90 has a degradation temperature of 117° C. or more. Hereinafter, D-90 is simply called as "Crosslinked Diphenylsulfone (1)".

Formula (1)

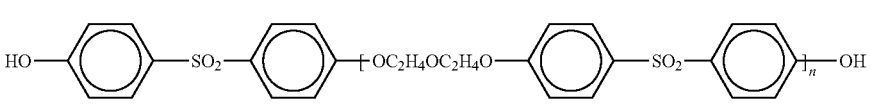

(1)

(6) Preparation of Heat-sensitive Recording Layer Coating Composition

A heat-sensitive recording layer coating composition was prepared by stirring a composition composed of 21.5 parts of Solution A (leuco dye content: 10.05 parts), 33 parts of Solution B (3,3'-diallyl-4,4'-dihydroxydiphenylsulfone content: 15 parts), 11.5 parts of Solution C (1,2-di(methylphenoxy) ethane content: 5.53 parts), 16.5 parts of Solution D (content of Crosslinked Diphenylsulfone (1): 7.5 parts), 98 parts of 10% aqueous solution of polyvinyl alcohol, 62 parts of 10% aqueous solution of oxidized starch, 20 parts of amorphous silica, 10 parts of light calcium carbonate, 30 parts of aqueous dispersion of zinc stearate (trade name: HIDORIN Z-8-36, solid content: 36%, manufactured by Chukyo Yushi Co., Ltd.), 3 parts of paraffin wax (trade name: HIDORIN P-7, solid content: 30%, manufactured by Chukyo Yushi Co., Ltd.), 5 parts of polyethylene wax (trade name: Chemipearl W-401, solid content: 40%, manufactured by Mitsui Chemicals, Inc.), and 120 parts of water. Total amount of solid contained in the prepared heat-sensitive recording layer coating composition was 100.95 parts.

(7) Manufacture of Heat-sensitive Recording Material No. 1

Heat-sensitive recording material No. 1 was manufactured by applying to one side of a 65 g/m$^2$ base paper the undercoat layer coating composition and the heat-sensitive recording layer coating composition in this order in an amount of 7.5 g/m$^2$ and 4.5 g/m$^2$ on a dry weight basis respectively. After formation of the under coat layer and the heat-sensitive recording layer respectively, each layer was subjected to a smoothing treatment by a supercalender.

[Manufacture of Heat-sensitive Recording Materials Nos. 2 to 8, 11 and 12]

Heat-sensitive recording materials Nos. 2 to 8, 11 and 12 were formed in the same manner as heat-sensitive recording material No. 1, except that amounts of Solutions B, C and D in the heat-sensitive recording layer coating composition were changed to the amounts shown in Table 1.

TABLE 1

| | | Coating composition for heat-sensitive recording layer | | | | | | | | | |
|---|---|---|---|---|---|---|---|---|---|---|---|
| | | No 1 | No 2 | No 3 | No 4 | No 5 | No 6 | No 7 | No 8 | No 11 | No 12 |
| Amount (part) | SolutionA | 21.5 | 21.5 | 21.5 | 21.5 | 21.5 | 21.5 | 21.5 | 21.5 | 21.5 | 21.5 |
| | SolutionB | 33 | 33 | 55 | 11 | 33 | 33 | 33 | 33 | 66 | 55 |
| | SolutionC | 11.5 | 11.5 | 11.5 | 11.5 | 31 | 2.1 | 11.5 | 11.5 | 42 | 42 |
| | SolutionD | 16.5 | 21 | 16.5 | 16.5 | 16.5 | 16.5 | 33 | 4.4 | 15 | 13 |
| Total mass of solid(part) | | 100.95 | 98.2 | 111.95 | 89.95 | 110.70 | 96.25 | 109.2 | 94.9 | 131.95 | 125.45 |

[Manufacture of Heat-sensitive Recording Material No. 9]

Heat-sensitive recording material No. 9 was formed in the same manner as heat-sensitive recording material No. 1, except that 4-hydroxy-4'-isopropoxydiphenylsulfone (Developer 2) was used instead of 3,3'-diallyl-4,4'-dihydroxydiphenylsulfone (Developer 1) when preparing Solution B.

[Manufacture of Heat-sensitive Recording Material No. 10]

Heat-sensitive recording material No. 10 was formed in the same manner as heat-sensitive recording material No. 1, except that 1,1,3-tris(2-methyl-4-hydroxy-5-cyclohexylphenyl)butane, which is known as a conventional preservation stabilizer, was used instead of Crosslinked Diphenylsulfone (1) when preparing Solution D.

the symbol X indicates milk resistance and barcode printability are not satisfactory in the fields where these properties are required.

The evaluation results are shown along with the content (%) of 1,1,2-di(3-methylphenoxy)ethane as a color developer relative to a leuco dye, the content (%) of Crosslinked Diphenylsulfone (1) based on the total solid content, and the content ratio (indicated by a:b in Table 2) of the Developer 1 and Crosslinked Diphenylsulfone (1). The amounts of the respective compounds in Table 2 are amounts (unit: parts) of the respective compounds in a coating composition.

TABLE 2

| | | No. | | | | | | | | | | | |
|---|---|---|---|---|---|---|---|---|---|---|---|---|---|
| | | 1 | 2 | 3 | 4 | 5 | 6 | 7 | 8 | 9 | 10*1 | 11 | 12 |
| Leuco dye Solution B | Amount | 10.05 | 10.05 | 10.05 | 10.05 | 10.05 | 10.05 | 10.05 | 10.05 | 10.05 | 10.05 | 10.05 | 10.05 |
| | Developer | Dev1 | Dev1 | Dev1 | Dev1 | Dev1 | Dev1 | Dev1 | Dev1 | Dev2 | Dev1 | Dev1 | Dev1 |
| | Amount(a) | 15 | 10.05 | 25 | 5 | 15 | 15 | 15 | 15 | 15 | 15 | 30 | 25 |
| | Content(% based on dye)*2 | 149 | 104 | 249 | 50 | 149 | 149 | 149 | 149 | 149 | 149 | 299 | 249 |
| Sensitizer | Amount | 5.5 | 5.5 | 5.5 | 5.5 | 14.9 | 1.0 | 5.5 | 5.5 | 5.5 | 5.5 | 20.2 | 20.2 |
| | Content(% based on dye)*2 | 55.0 | 55.0 | 55.0 | 55.0 | 148 | 10 | 55.0 | 55.0 | 55.0 | 55.0 | 200 | 200 |
| Crosslinked sulfone (1) | Amount (b) | 7.5 | 9.5 | 7.5 | 7.5 | 7.5 | 7.5 | 15 | 2.0 | 7.5 | 0 | 6.8 | 5.9 |
| | Content(%) based on total solid | 7.4 | 9.7 | 6.7 | 8.3 | 6.8 | 7.8 | 13.7 | 2.1 | 7.4 | — | 5.2 | 4.7 |
| Amount ratio (a:b) | | 1:0.5 | 1:0.92 | 1:0.3 | 1:1.5 | 1:0.5 | 1:0.5 | 1:1 | 1:0.13 | — | — | 1:0.23 | 1:0.24 |
| Evaluation | Plasticizer resistance(%) | 14 | 15 | 17 | 19 | 15 | 18 | 16 | 14 | 19 | 15 | 13 | 13 |
| | Oil resistance(%) | 17 | 18 | 24 | 25 | 16 | 22 | 16 | 18 | 28 | 19 | 18 | 18 |
| | Barcode printability | A | B | B | C | D | C | C | B | B | B | D | D |
| | Milk resistance(%) | 22 | 25 | 32 | 37 | 27 | 38 | 28 | 35 | 46 | 39 | 33 | 31 |
| | Total evaluation | ◎ | ○ | Δ | X | Δ | X | Δ | Δ | Δ | Δ | X | X |

Dev. 1: 3,3'-diallyl-4,4'-dihydroxydiphenylsulfone

Dev. 2: 4-hydroxy-4'-isopropoxydiphenylsulfone

Crosslinked sulfone (1): Crosslinked Diphenylsulfone (1)

*1containing 1,1,3-tris(2-methyl-4-hydroxy-5-cyclohexylphenyl)butane as a preservation stabilizer

*2corresponding to the amount relative to 100 parts of leuco dye

Plasticizer resistance, oil resistance, barcode printability, and milk resistance were evaluated with respect to the heat-sensitive recording materials No. 1 through 12, according to the aforementioned evaluation method. The total evaluation was performed based on the following four criteria:

the symbol ◎ indicates superior performance in all the properties i.e. plasticizer resistance, oil resistance, barcode printability, and milk resistance;

the symbol ○ indicates satisfactory performance in all the properties i.e. plasticizer resistance, oil resistance, barcode printability, and milk resistance;

the symbol Δ indicates one of barcode printability and milk resistance is not satisfactory, although plasticizer resistance and oil resistance are satisfactory; and No. 9 is an example free of Developer 1. No. 10 is an example free of Crosslinked Diphenylsulfone (1). In both of the examples, satisfactory milk resistance could not be secured, even if the contents of the color developer and the sensitizer relative to the leuco dye lied in the ranges specified in the invention, respectively. In other words, it is necessary to use the Developer 1 in combination with the Crosslinked Diphenylsulfone (1) in order to secure milk resistance.

No. 3 is an example containing an excessive amount of Developer 1. No. 5 is an example containing an excessive amount of 1,2-di(3-methylphenoxy)ethane. Nos. 11 and 12 are examples containing an excessive amount of both Developer 1 and 1,2-di(3-methylphenoxy)ethane. Particularly, in the case where an excessive amount of the sensitizer was used (Nos. 5, 11, and 12), the energy range for obtaining a practically usable barcode was narrow. As a result of comparison among Nos. 3, 5, 11, and 12, if the content ratio (b/a) of Crosslinked Diphenylsulfone (1) to Developer 1 is 0.3 or less, it is conceived that milk resistance is low. Low milk resistance means that printed images become decolored fast by contacting with milk, despite a large initial printed density.

On the other hand, No. 4 is an example containing a less amount of Developer 1. No. 6 is an example containing a less amount of 1,2-di(3-methylphenoxy)ethane. In both of the examples, a printed density by application of a predetermined heat energy was insufficient. As a result, even if a sufficient amount of Crosslinked Diphenylsulfone (1) was contained (Nos. 4 and 6), or even if the content ratio (b/a) of Crosslinked Diphenylsulfone (1) to Developer 1 was 0.5 (No. 6), satisfactory milk resistance could not be secured.

Even if the contents of Developer 1 and 1,2-di(3-methylphenoxy)ethane relative to the leuco dye were in the ranges specified in the invention, respectively, if the content of Crosslinked Diphenylsulfone (1) was unduly small, satisfactory milk resistance could not be secured (No. 8). If, on the other hand, the content of Crosslinked Diphenylsulfone (1) was unduly large, barcode printability was poor (No. 7), despite that the amounts of Developer 1 and 1,2-di(3-methylphenoxy)ethane were in the ranges specified in the invention, respectively. Conceivably, this may because a reaction of the leuco dye with Developer 1 and 1,2-di(3-methylphenoxy) ethane is suppressed by Crosslinked Diphenylsulfone (1).

Whereas at least one of milk resistance and barcode printability was not satisfactory in Nos. 3 through 12, Nos. 1 and 2 containing Developer 1, 1,2-di(3-methypheoxy)ethane, and Crosslinked Diphenylsulfone (1) in the respective amounts falling in the specific range of the invention showed satisfactory barcode printability and milk resistance of the printed images, not to mention plasticizer resistance and oil resistance of the printed images. Particularly, No. 1 having the content ratio (a:b)=1:0.5 showed advantageously superior barcode printability and milk resistance.

The inventive heat-sensitive recording material has superior milk resistance of printed images, as well as oil resistance and plasticizer resistance of the printed images without impairing barcode printability. Accordingly, the inventive heat-sensitive recording material can be utilized as cash vouchers or like articles, whose printed images are required to be preserved for a long term with no or less color degradation or a like drawback during a long-term preservation in households under possible exposure to foods, drugs, or like household goods.

What is claimed is:

1. A heat-sensitive recording material having a support and a heat-sensitive recording layer placed over the support, the heat-sensitive recording layer comprising:

a leuco dye;

a color developer including 3,3'-diallyl-4,4'-dihydroxydiphenylsulfone;

a sensitizer including 1,2-di(methylphenoxy)ethane;

a crosslinked diphenylsulfone-based compound represented by the general formula (1) wherein n represents an integer of from 1 to 7; and a binder wherein the amount of the 3,3'-diallyl-4,4'-dihydroxydiphenylsulfone is in the range of 100 to 200 parts by mass and the amount of the 1,2-di(methylphenoxy) ethane is in the range of 20 to 90 parts by mass, the parts by mass being based on 100 part by mass of the leuco dye, and the amount of the crosslinked diphenylsulfone-based compound falls in the range of 5 to 10% by mass based on the total mass of solid contained in the heat-sensitive recording layer (1)

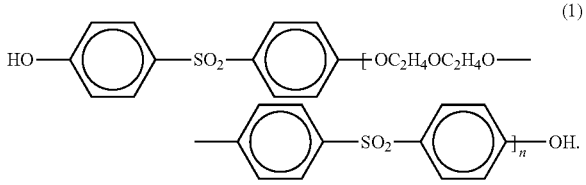

2. The heat-sensitive recording material according to claim 1, wherein the amount ratio of 3,3'-diallyl-4,4'-dihydroxydiphenylsulfone to the crosslinked diphenylsulfone-based compound falls in the range of 1:0.4 to 1:0.8.

3. The heat-sensitive recording material according to claim 1, wherein the crosslinked diphenylsulfone-based compound has a degradation temperature of 110 to 180 degree C.

4. The heat-sensitive recording material according to claim 1, wherein the amount of the leuco dye is in the range of 5 to 25% by mass based on the total mass of solid contained in the heat-sensitive recording layer, and wherein the amount of the color developer is in the range of 170 to 400 parts by mass and the amount of the sensitizer is in the range of 20 to 120 parts by mass, the parts by mass being based on the 100 parts by mass of the leuco dye.

5. The heat-sensitive recording material according to claim 1, wherein an amount of the binder is in the range of 5 to 30% by mass based on the total mass of solid contained in the heat-sensitive recording layer.

6. A method of producing a heat-sensitive recording material obtainable a printed image having milk resistance comprising:

a step of preparing a composition which contains 3,3'-diallyl-4,4'-dihydroxydiphenylsulfone in an amount of 100 to 200 parts by mass and 1,2-di(methylphenoxy) ethane in an amount of 20 to 90 parts by mass relative to 100 parts by mass of the leuco dye, and contains a crosslinked diphenylsulfone-based compound represented by the general formula (1) in a concentration of 5 to 10% by mass based on the total mass of solid contained in the heat-sensitive recording layer wherein n represents an integer of from 1 to 7; and a step of forming a heat-sensitive recording layer of the composition (1)

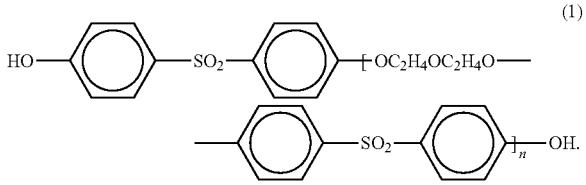

7. The method of producing a heat-sensitive recording material according to claim 6, wherein the printed image has a reflectance of 30% or less at a wavelength of 660 nm, after the thermal-recorded heat-sensitive recording material is immersed in milk for 12 hours, taken out of the milk, followed by removal of an excess of milk by absorption and dried.

* * * * *